US011214064B2

(12) United States Patent
Coventry et al.

(10) Patent No.: US 11,214,064 B2
(45) Date of Patent: Jan. 4, 2022

(54) ADHERING LAYERS OF FLUIDIC DIES

(71) Applicant: HEWLETT-PACKARD DEVELOPMENT COMPANY, L.P., Spring, TX (US)

(72) Inventors: Laurie A. Coventry, Corvallis, OR (US); David R. Thomas, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,582

(22) PCT Filed: Apr. 2, 2018

(86) PCT No.: PCT/US2018/025671
§ 371 (c)(1),
(2) Date: Oct. 7, 2019

(87) PCT Pub. No.: WO2019/194785
PCT Pub. Date: Oct. 10, 2019

(65) Prior Publication Data

US 2021/0331475 A1 Oct. 28, 2021

(51) Int. Cl.
*B41J 2/16* (2006.01)
*B41J 2/14* (2006.01)

(52) U.S. Cl.
CPC ..... *B41J 2/1631* (2013.01); *B41J 2/1623* (2013.01); *B41J 2/1626* (2013.01); *B41J 2002/14491* (2013.01)

(58) Field of Classification Search
CPC ..... B41J 2/1631; B41J 2/1626; B41J 2/1623; B41J 2002/14491
See application file for complete search history.

(56) References Cited

U.S. PATENT DOCUMENTS 4,862,197 A 8/1989 Stoffel
6,450,622 B1 9/2002 Nguyen et al.
(Continued)

FOREIGN PATENT DOCUMENTS

JP 2003224269 8/2003
JP 2014503398 1/2011
(Continued)

OTHER PUBLICATIONS

IP.com search (Year: 2021).*

*Primary Examiner* — Lisa Solomon
(74) *Attorney, Agent, or Firm* — Trop Pruner & Hu PC

(57) ABSTRACT

In some examples, a fluidic die includes a substrate, a fluidic region comprising fluid chambers formed in a fluidic barrier layer supported by the substrate, fluidic actuators associated with the fluid chambers, electrical structures positioned away from the fluidic region, a metallic layer over the fluidic actuators, and an adherent barrier layer to adhere the metallic layer to the fluidic barrier layer. The adherent barrier layer includes a first adherent barrier layer portion comprising a dielectric layer and an adhesion layer, and a second adherent barrier layer portion comprising the adhesion layer and without the dielectric layer, the first adherent barrier layer portion formed over the electrical structures, and the second adherent barrier layer portion formed in the fluidic region, the adhesion layer of the second adherent barrier layer portion protruding into the fluid chambers.

15 Claims, 4 Drawing Sheets

(56) References Cited

U.S. PATENT DOCUMENTS

| | | | | |
|---|---|---|---|---|
| 7,758,169 | B2 | 7/2010 | Emery et al. | |
| 2003/0098900 | A1 * | 5/2003 | Tokunaga | B41J 2/1628 347/63 |
| 2005/0056569 | A1 | 3/2005 | Yuan et al. | |
| 2005/0227349 | A1 | 10/2005 | Kim et al. | |
| 2007/0243634 | A1 | 10/2007 | Pamula et al. | |
| 2012/0298622 | A1 | 11/2012 | White et al. | |
| 2013/0034703 | A1 | 2/2013 | Marty et al. | |
| 2016/0228893 | A1 | 8/2016 | Winger | |
| 2016/0325547 | A1 | 11/2016 | White et al. | |
| 2017/0368823 | A1 | 12/2017 | Chen et al. | |

FOREIGN PATENT DOCUMENTS

| | | |
|---|---|---|
| JP | 2015193239 | 11/2015 |
| JP | 2017094571 | 6/2017 |
| WO | WO2017011011 A1 | 1/2017 |

* cited by examiner

ADHERING LAYERS OF FLUIDIC DIES

BACKGROUND

A fluidic die can be used in fluid dispensing systems, such as printing systems or other types of fluid dispensing systems. The fluidic die includes a substrate and various layers built onto the substrate using semiconductor fabrication techniques. The layers supported by the substrate form electrical components and fluidic structures, such as fluid chambers, fluid channels, orifices, and so forth.

BRIEF DESCRIPTION OF THE DRAWINGS

Some implementations of the present disclosure are described with respect to the following figures.

Figure 1:
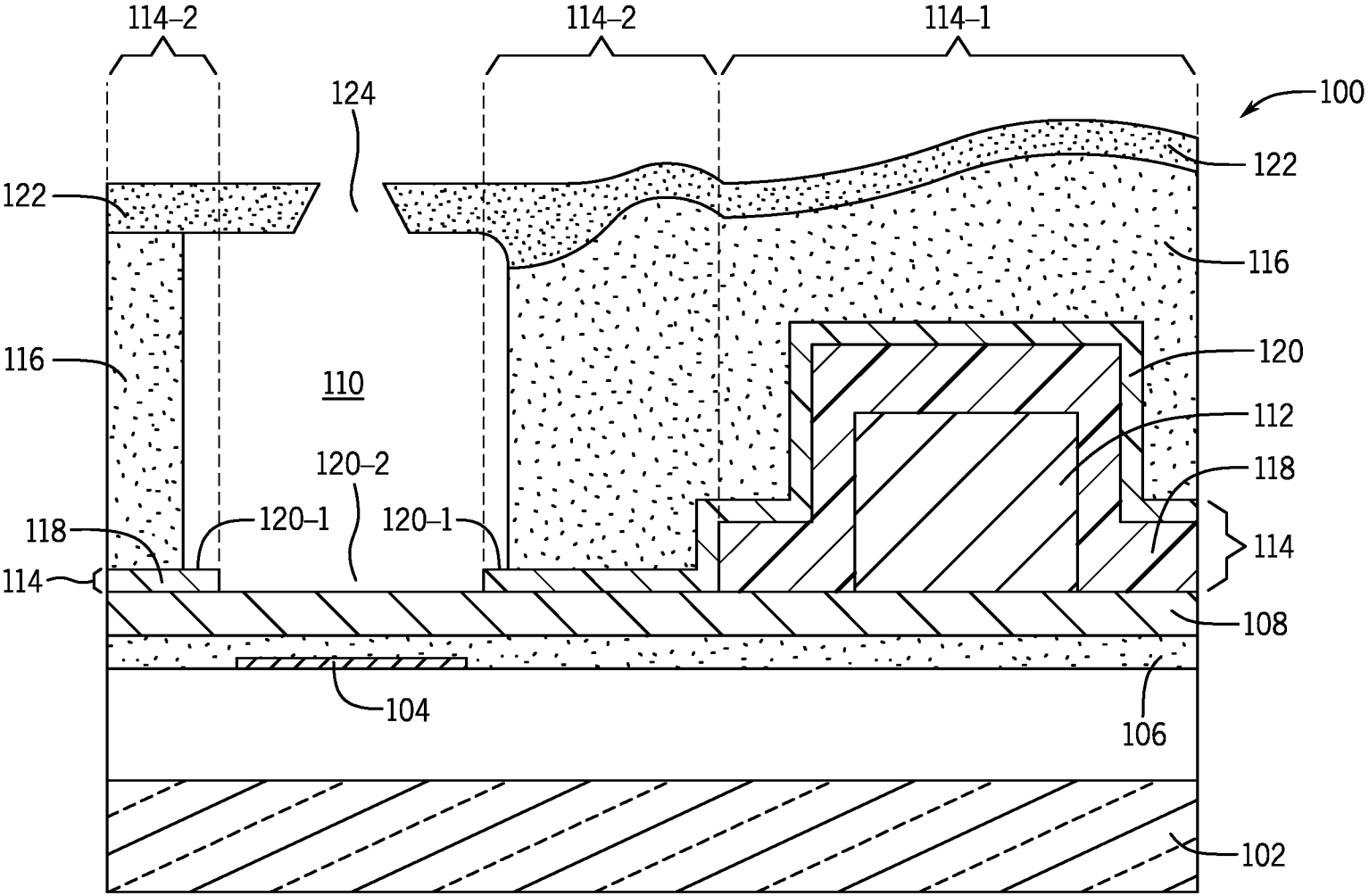
FIG. 1 is a partial cross-sectional view of a portion of a fluidic die, according to some examples

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluidic die can include fluidic actuators that when activated cause dispensing (e.g., ejection or other flow) of a fluid. For example, the dispensing of the fluid can include ejection of fluid droplets by activated fluidic actuators from respective nozzles of the fluidic die. In other examples, an activated fluidic actuator (such as a pump) can cause fluid to flow through a fluid channel or fluid chamber. Activating a fluidic actuator to dispense fluid can thus refer to activating the fluidic actuator to eject fluid from a nozzle or activating the fluidic actuator to cause a flow of fluid through a flow structure, such as a flow channel, a fluid chamber, and so forth.

In build a fluidic die, various layers can be formed onto a substrate of the fluidic die, such as by using semiconductor processing techniques. The layers that can be provided onto the substrate include layers are used for forming transistors, fluidic actuators, electrical structures, fluid chambers, fluid channels, fluid orifices, and so forth.

Fluid chambers of a fluidic die can be formed in a fluidic barrier layer. In some examples, the fluidic barrier layer can include an organic material or a polymer material. For example, the barrier layer can include an epoxy, a silicone dielectric, and so forth. An example of a polymer material used in the fluidic barrier layer is SUB, which is an epoxy-based photoresist.

Portions of the fluidic die include metallic layers. A die surface optimization (DSO) layer can be used to provide an adherent barrier layer between the metallic layers and the fluidic barrier layer in which the fluid chambers are formed. The DSO layer provides adhesion between the metallic layers and the fluidic barrier layer.

Although reference is made to a DSO layer in some examples, more generally, a fluidic die includes an adherent barrier layer that is used to adhere one portion of the fluidic die (such as a metallic layer or multiple metallic layers) to a fluidic barrier layer in which fluid chambers are formed.

In some examples, the DSO layer is formed using just silicon carbide (SiC) over both electrical structures as well as fluidic regions of the fluidic die. However, use of an SiC-only DSO layer can lead to fluid ingress into areas around electrical structures (e.g., electrical contacts, electrical buses, electrical traces, or any other structure that provides electrical connectivity) of the fluidic die. For example, moisture can diffuse from the fluid chambers in the fluidic barrier layer to the electrical structures. As another example, an edge of the fluidic barrier layer can lift up from an underlying layer, which can allow fluid to ingress to regions around electrical structures. Fluid diffusion or leakage can cause corrosion of the electrical structures, which can lead to failure of electrical circuitry of the fluidic die.

In other examples, the DSO layer can include both an SiC layer and a silicon nitride (SiN) layer. However, in examples where both the SiC layer and the SiN layer extend to the fluid chambers of the fluidic die, the SiN layer may chemically react with the fluid in the fluid chambers. This chemical reaction can cause erosion of the SiN layer.

During a photolithographic patterning process to pattern a fluidic barrier layer to form fluid chambers, optical reflections can lead to deformities in the fluidic barrier layer. To avoid such deformities in the fluidic barrier layer caused by optical reflections, the pitch between fluid chambers have to be increased beyond the range of the optical reflections. An increased pitch between the fluid chambers of a fluidic die can lead to reduced print qualities in printing applications, since the increased pitch leads to a reduced number of nozzles per unit area. For example, printing at 600 dots per inch results in reduced print quality when compared to printing at 1,200 dots per inch. Also, in designs where the SiN layer of the DSO layer extends to the fluid chambers, a portion of the fluidic barrier layer may have to be used to cover the SiN layer to protect the SiN layer from corrosion by fluid in the fluid chambers. This also leads to increased pitch between fluid chambers.

In accordance with some implementations of the present disclosure, a DSO layer includes a first DSO layer portion that covers electrical structures, and a second DSO layer portion that is provided in fluidic regions of a fluidic die. The first DSO layer portion that covers electrical structures of the fluidic die includes both a dielectric layer (e.g., an SiN layer) and an adhesion layer (e.g., an SiC layer). The second DSO layer portion includes the adhesion layer without the dielectric layer. As explained further below, the adhesion layer is anti-reflective to aid in manufacturability of fluidic dies with denser arrangements of fluid chambers.

FIG. 1 shows an example cross-sectional view of a portion of a fluidic die 100. The portion shown in FIG. 1 forms a nozzle of the fluidic die 100. The structures shown in FIG. 1 can be repeated to form other nozzles of the fluidic die 100. It is noted that just some of the layers of the portion of the fluidic die 100 are shown, with the remaining layers not depicted for ease of understanding.

The various layers shown in FIG. 1 are supported by a substrate 102. The substrate 102 can include silicon or another semiconductor material. Alternatively, the substrate 102 can include a different type of material A fluidic actuator layer 104 forms a fluidic actuator. In examples where fluidic actuators include resistive heaters, the fluidic actuator layer 104 includes an electrically resistive material. In other examples where fluidic actuators include piezoelectric membranes, the fluidic actuator layer 104 includes a piezoelectric material.

Note that various intermediate layers between the fluidic actuator layer 104 and the substrate 102 are not shown in FIG. 1. The intermediate layers can be used to form transistors, vias, and other structures.

A passivation layer 106 is provided over the fluidic actuator layer 104. The passivation layer 106 can include a layer formed of an electrically insulating material, or multiple layers formed of different electrically insulating materials. Examples of electrically insulating materials for the passivation layer 106 includes any or some combination of a nitride containing layer (e.g., SiN), an oxide containing layer (e.g., silicon dioxide or $SiO_2$), a carbon containing layer (e.g., SiC), and so forth.

A cavitation barrier layer 108 is provided over the passivation layer 106. In some examples, the cavitation barrier layer 108 can include tantalum (Ta). In other examples, the cavitation barrier layer 108 can include a different material, such as another metallic material or a different material. The cavitation barrier layer 108 can serve as a die cavitation and adhesion layer.

Since fluidic actuators are placed in proximity to the fluid chambers 110 of the fluidic die 100 to allow activation of the fluidic actuators to cause movement of fluid in the fluid chambers, the cavitation barrier layer 108 provided between the fluidic actuators and the fluid chambers protects the fluidic actuators from forces applied by fluid transitions in the fluid chambers. The expansion and contraction of fluid in a fluid chamber 100 can produce a mechanical impact. The cavitation barrier layer 108 aids in preserving the fluidic actuators from the mechanical impact of fluid expansion and contraction in the fluid chamber 110, over many repeated activations of the fluidic actuator that cause fluid transitions in the fluid chamber 110. The cavitation barrier layer 108 can also serve to provide adhesion between the passivation layer 106 and other layers above the cavitation barrier layer 108.

As further shown in FIG. 1, an electrical structure 112 can be formed over the cavitation barrier layer 108. The electrical structure 112 can include an electrical contact, an electrical trace, an electrical bus, and so forth. For example, the electrical structure can be used to carry power or ground, which is electrically connected or coupled to the corresponding fluidic actuator for controlling activation of the fluidic actuator.

Although not shown, an electrical via can connect the electrical structure 112 to the fluidic actuator layer 104.

FIG. 1 further shows a DSO layer 114 (or more generally, an adherent barrier layer) between the metallized portions of the fluidic die, including the cavitation barrier layer 108 and the electrical structures 112, and a fluidic barrier layer 116.

The DSO layer 114 includes a first DSO layer portion 114-1 and a second DSO layer portion 114-2. The first DSO layer portion 114-1 includes a dielectric layer 118 and an adhesion layer 120.

In some examples, the dielectric layer 118 can include a material that is electrically insulating, such as SiN, $SiO_2$, and so forth. The dielectric layer 118 can be a passivation layer. Moreover, the dielectric layer 118 can provide a moisture barrier that prevents diffusion of fluid in the fluid chamber 110 through the dielectric layer 118 to the electrical structures 112.

The adhesion layer 120 can include a carbon containing material, such as SiC. The adhesion layer 120 can aid in adhesion between the metallized surfaces (e.g., the surfaces of the cavitation barrier layer 108 and of the electrical structures 112) of the fluidic die 100 and the fluidic barrier layer 116. In further examples, the adhesion layer 120 is an organic bonding layer to bond a surface of the fluidic die to an organic material of the fluidic barrier layer 116.

In examples where the first DSO layer portion 114-1 includes just two layers (the dielectric layer 118 and the adhesion layer 120), the first DSO layer portion 114-1 is referred to as a dual stack DSO layer. However, in other examples, the first DSO layer portion 114-1 can include more than two layers, such as for example, an electrically conductive layer underneath the dielectric layer 118. This electrically conductive layer of the DSO layer can include a refractory metal or a refractory metal alloy, such as titanium, tantalum, chromium, cobalt, molybdenum, platinum, tungsten, zirconium, hafnium, vanadium, or a combination, or any combination of the foregoing.

The second DSO layer portion 114-2 includes the adhesion layer 120, without the dielectric layer 118. In some examples, the second DSO layer 114-2 can include only the adhesion layer 120. In other examples, the second DSO layer portion 114-2 can include the adhesion layer 120 and a refractory metal layer, but without the dielectric layer 118.

The adhesion layer 120 is provided between the fluid chambers 110 and the dielectric layer 118 to isolate fluid in the fluid chambers 110 from the dielectric layer 118.

The fluidic barrier layer 116 is patterned to form the fluid chamber 110. A portion of the adhesion layer 120 protrudes into the fluid chamber 110. The protruding portion of the adhesion layer 120 is identified as 120-1 in FIG. 1.

In examples according to FIG. 1, the protruding portion 120-1 of the adhesion layer 120 protrudes (in a lateral or horizontal direction of the fluidic die 100 in the view of FIG. 1) partially into the fluid chamber, such that an opening 120-2 in the adhesion layer 120 is formed. This opening 120-2 in the adhesion layer 120 allows energy from the fluidic actuator layer 104 to pass through the layers 106, 108, and through the opening 120-2 to the fluid in the fluid chamber 110.

If the fluidic actuator layer 104 includes an electrically resistive material that when energized produces heat, then thermal energy from the activated fluidic actuator layer (activated by application of an electrical current) passes through the layers 106, 108 and the opening 120-2 to heat the fluid in the fluid chamber 110.

A thickness of the adhesion layer 120 can be adjusted to form an interference anti-reflective layer. For example, if the adhesion layer 120 includes SiC, then the thickness of the SiC layer 120 can be selected to be about 1,500 angstroms (A), or can be selected to be greater than about 700 A. In other examples, other thicknesses of the adhesion layer 120 can be used. The thickness of the adhesion layer 120 is selected such reflections from the top surface of the adhesion layer 120 and reflections from the bottom surface of the adhesion layer 120 cancel each other out, or at least reduces the overall magnitude of light reflections (due to interference of the reflected light from the top and bottom surfaces of the adhesion layer 120).

As a result, during photolithographic processing of the fluidic barrier layer 116 to form fluid chambers 110, optical reflections are reduced, which reduces the intensity of non-specular reflections to prevent crosslinking of the material (e.g., SU8) of the fluidic barrier layer 116. This reduces deformities in the fluidic barrier layer 116, which allows a smaller pitch to be provided between the fluid chambers 110 of the fluidic die 100. The smaller pitch allows a greater density of fluid chambers 110 to be provided.

The protruding portion 120-1 of the adhesion layer 120 is shadowed during the fluidic barrier layer 116 photolithographic process, which eliminates the possibility of reflections from the film edge of the adhesion layer 120. Shadowing the protruding portion 120-1 refers to using a light blocking layer during the photolithographic process of patterning the fluidic barrier layer 116 (for forming the fluid chambers 110) to block light from reaching the protruding portion 120-1 of the adhesion layer 120, such that reflection from the protruding portion 120-1 is eliminated or reduced.

As shown in FIG. 1, since just the adhesion layer 120 extends to the fluid chamber 110, a portion of the fluidic barrier layer 116 does not have to cover the DSO layer 114 at the fluid chamber 110, which also allows for reducing the pitch between fluid chambers.

In further examples, an orifice barrier layer 122 can be formed over the fluidic barrier layer 116. The orifice barrier layer 122 can be patterned to form an orifice 124, through which fluid in the fluid chamber 110 can be dispensed, such as to provide a printing fluid to a target.

Figure 2C:
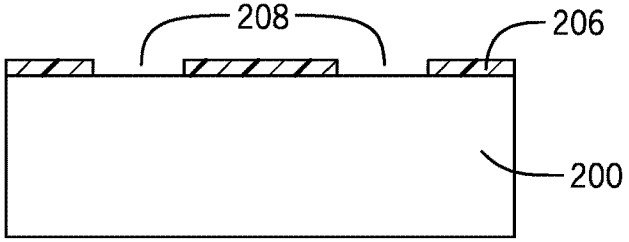
FIGS. 2B-2E are partial cross-section views of the fluidic die of FIG. 2A at various different stages of forming a die surface optimization (DSO) layer, according to some examples.
Figure 2B:
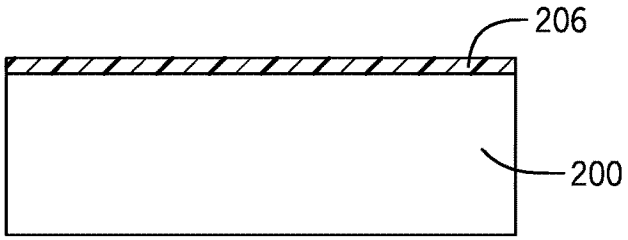
Figure 2E:
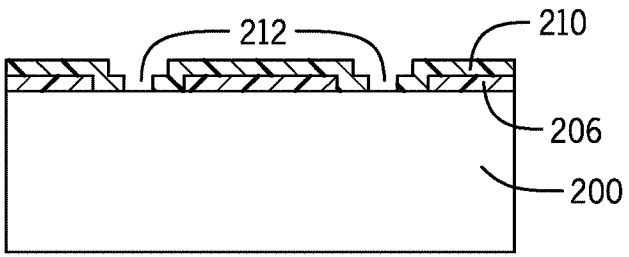
Figure 2D:
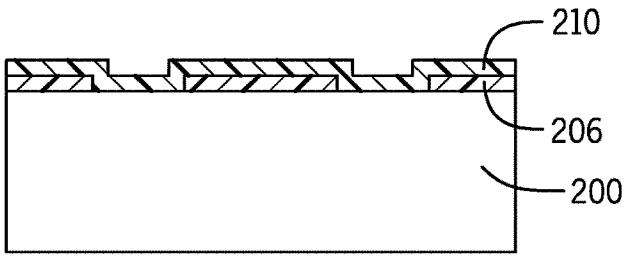
Figure 2A:
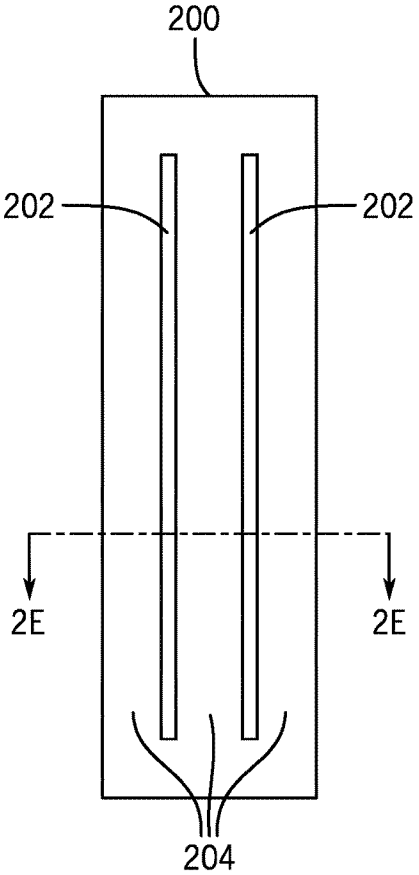
FIG. 2A is a top view of a fluidic die according to some examples.

FIGS. 2A-2E illustrate an example of the formation of a DSO layer of a fluidic die according to some examples. FIG. 2A shows a partially formed fluidic die 200 that includes fluidic regions 202 and non-fluidic regions 204. The fluidic regions 202 of the fluidic die 200 are the regions that include fluid chambers, such as the fluid chambers 110, associated with fluidic actuators. In the example of FIG. 2A, the fluidic regions 202 include two arrays of fluid chambers (e.g., two columns of fluid chambers that are part of two columns of nozzles).

The non-fluidic regions 204 are the regions away from the fluidic regions 202. Electrical structures (such as 112 shown in FIG. 1) can be formed in the non-fluidic regions 204.

FIGS. 2B-2E are cross-section views (along section 2E-2E) of the fluidic die 200 of FIG. 2A, at various respective stages of formation of a DSO layer.

In FIG. 2B, an SiN layer 206 (which is an example of the dielectric layer 118 of FIG. 1) is formed over the partially formed fluidic die 200. Next, as shown in FIG. 2C, the SiN layer 206 is etched (e.g., wet etched, dry etched, photo-patterned, etc.) to form windows 208 in the SiN layer 206. The windows 208 correspond to the fluidic regions 202 of the fluidic die 200.

Next, as shown in FIG. 2D, an SiC layer 210 is formed over the patterned SiN layer 206. The SiC layer 210 is an example of the adhesion layer 120 of FIG. 1. The SiC layer 210 covers the SiN layer 206, and also is formed in the windows 208 where the SiN layer 206 has been removed.

Next, as shown in FIG. 2E, the SiC layer 210 is etched to form openings 212 in the SiC layer 210 corresponding to the fluid chambers 110 (fluidic actuators). An example of such openings 212 is the opening 120-2 shown in FIG. 1.

Following the etching of the SiC layer 210 to form the openings 212, a fluidic barrier layer (e.g., 116 in FIG. 1) can be formed over the SiC layer 210. The DSO layer including the SiN layer 206 and the SiC layer 210 provides an adherent barrier layer between the metallized portions of the fluidic die 200 and the fluidic barrier layer. The fluidic barrier layer can then be subjected to photolithographic processing, with the SiC layer portions protruding into the fluidic regions 202 providing an anti-reflective material to aid in manufacturing fluid chambers with higher densities.

By using an adherent barrier layer according to some implementations of the present disclosure, the presence of both a dielectric layer and adhesion layer in non-fluidic regions of a fluidic die helps to protect electrical structures from intrusion of fluids that can cause corrosion of the electrical structures. Moreover, use of the adherent barrier layer with the adhesion layer but not the dielectric layer in the fluidic regions of the fluidic die allows for isolation of the dielectric layer from corrosive effects of the fluid, and also, allows the anti-reflective characteristics of the adhesion layer to aid in manufacturing fluid chambers in a fluidic barrier layer with tighter tolerances. The adhesion layer of the adherent barrier layer is more anti-reflective than the dielectric layer of the adherent barrier layer.

Figure 3:
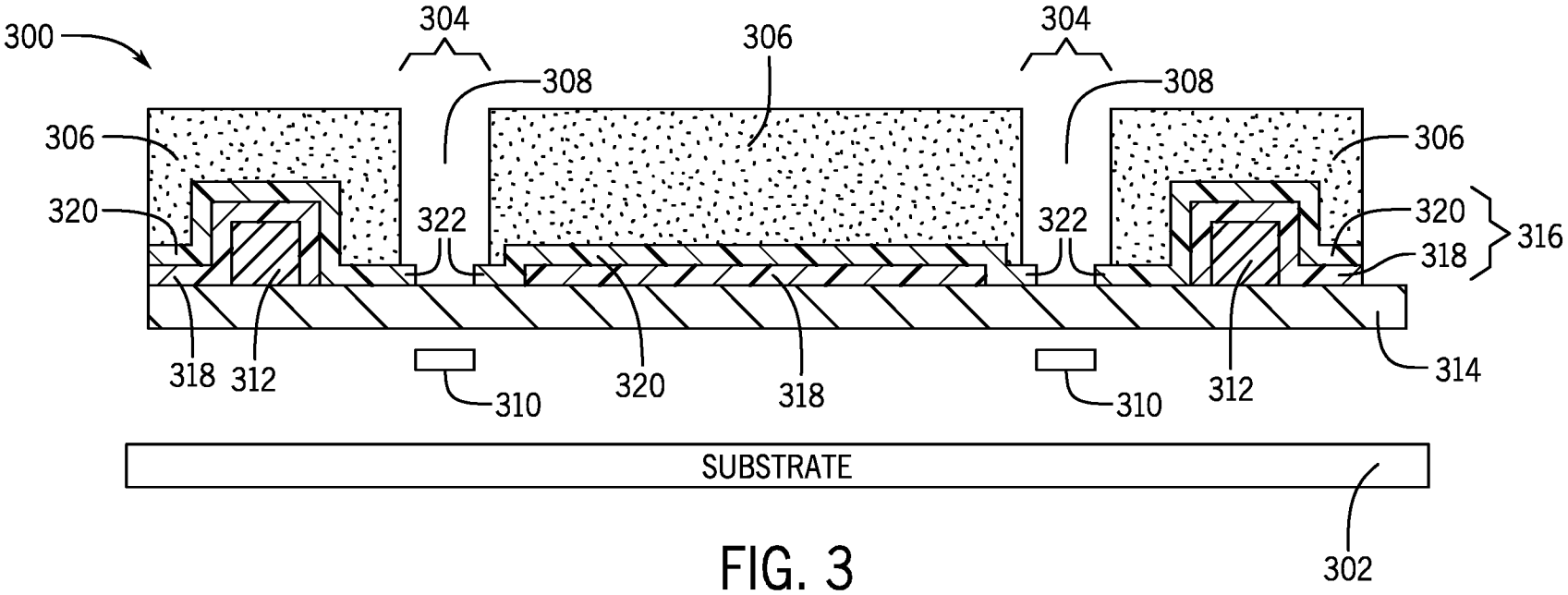
FIG. 3 is a partial cross-sectional view of a fluidic die according to further examples.

FIG. 3 is a block diagram of a fluidic die 300 that includes a substrate 302, a fluidic region 304 comprising fluid chambers 308 formed in a fluidic barrier layer 306 that is supported by the substrate 302, fluidic actuators 310 associated with the fluid chambers 306, and electrical structures 312 positioned away from the fluidic region 304.

A metallic layer 314 is provided over the fluidic actuators 310. The metallic layer 314 is part of a cavitation barrier layer to protect the fluidic actuators 310 from impacts caused by fluid transitions in the fluidic chambers 308.

An adherent barrier layer (e.g., a DSO layer) 316 adheres the metallic layer 314 to the fluidic barrier layer 306. The adherent barrier layer 316 includes a first adherent barrier layer portion comprising a dielectric (e.g., SiN) layer 318 and an adhesion (e.g., SiC) layer 320, and a second adherent barrier layer portion comprising the adhesion layer 320 and without the dielectric layer 318. The first adherent barrier layer portion is formed over the electrical structures 312, and the second adherent barrier layer portion is formed in the fluidic region 304. The adhesion layer 320 of the second adherent barrier layer portion protrudes (322) into the fluid chambers 308.

Figure 4:
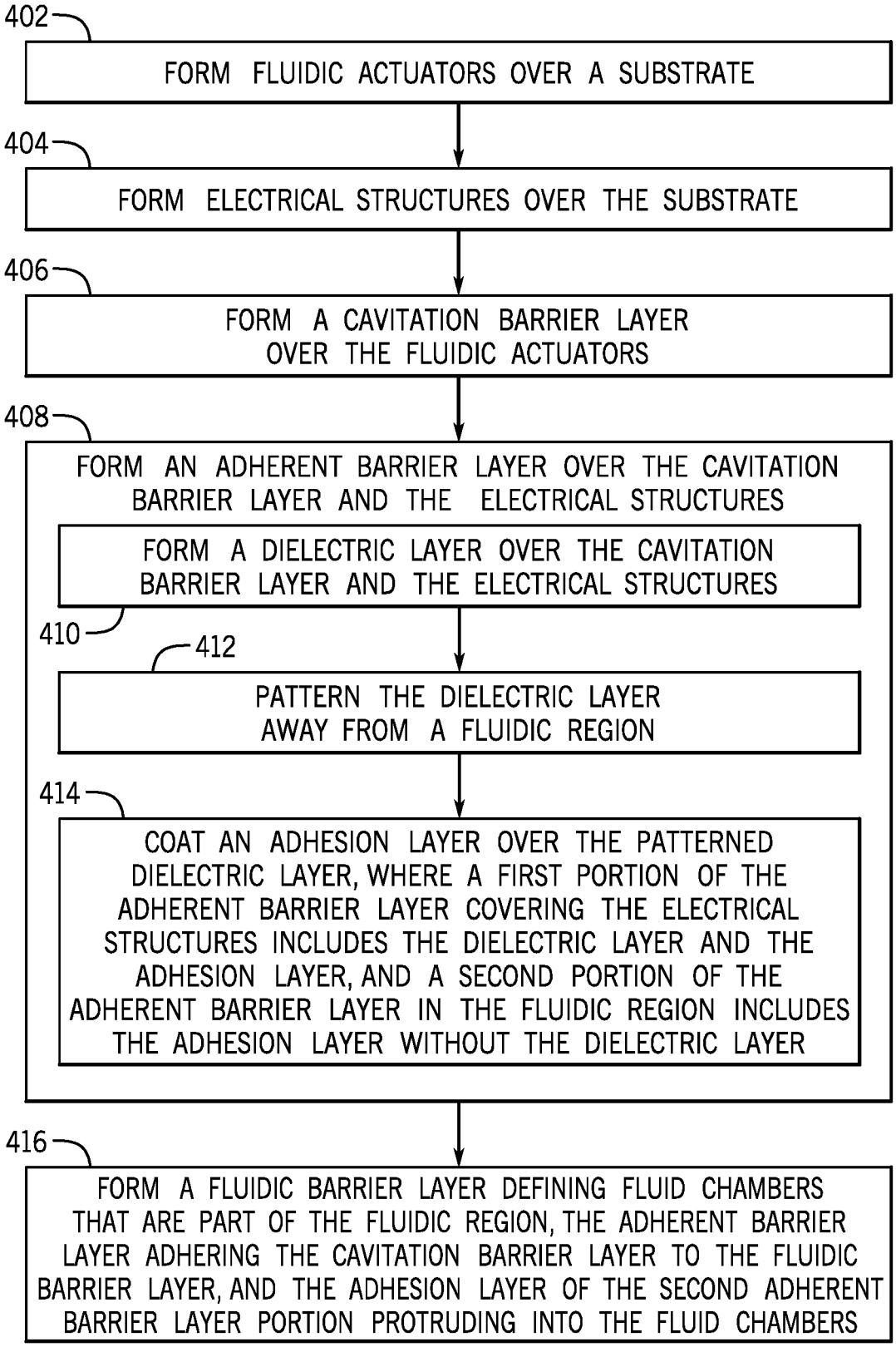
FIG. 4 is a flow diagram of a process of forming a fluidic die according to additional examples.

FIG. 4 is a flow diagram of a process of forming a fluidic die according to some examples. The process includes forming (at 402) fluidic actuators over a substrate, forming (at 404) electrical structures over the substrate, forming (at 406) a cavitation barrier layer over the fluidic actuators, forming (at 408) an adherent barrier layer over the cavitation barrier layer and the electrical structures.

Forming (at 408) the adherent barrier layer includes forming (at 410) a dielectric layer over the cavitation barrier layer and the electrical structures, patterning (at 412) the dielectric layer away from a fluidic region, and coating (at 414) an adhesion layer over the patterned dielectric layer, where a first portion of the adherent barrier layer covering the electrical structures includes the dielectric layer and the adhesion layer, and a second portion of the adherent barrier layer in the fluidic region includes the adhesion layer without the dielectric layer.

The process further includes forming (at 416) a fluidic barrier layer defining fluid chambers that are part of the fluidic region, the adherent barrier layer adhering the metallic layer to the fluidic barrier layer, and the adhesion layer of the second adherent barrier layer portion protruding into the fluid chambers.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluidic die comprising:

a substrate;

a fluidic region comprising fluid chambers formed in a fluidic barrier layer supported by the substrate;

fluidic actuators associated with the fluid chambers;

electrical structures positioned away from the fluidic region;

a metallic layer over the fluidic actuators; and an adherent barrier layer to adhere the metallic layer to the fluidic barrier layer, the adherent barrier layer comprising a first adherent barrier layer portion comprising a dielectric layer and an adhesion layer, and a second adherent barrier layer portion comprising the adhesion layer and without the dielectric layer, the first adherent barrier layer portion formed over the electrical structures, and the second adherent barrier layer portion formed in the fluidic region, the adhesion layer of the second adherent barrier layer portion protruding into the fluid chambers.

2. The fluidic die of claim 1, wherein the adhesion layer is an interference anti-reflective layer to reduce optical reflection when performing photolithography patterning of the fluidic barrier layer to form the fluid chambers.

3. The fluidic die of claim 1, wherein the adhesion layer is provided between the fluid chambers and the dielectric layer to isolate fluid in the fluid chambers from the dielectric layer.

4. The fluidic die of claim 1, wherein the adhesion layer of the second adherent barrier layer portion protrudes partially into the fluid chambers such that an opening in the adhesion layer is provided between a respective fluidic actuator of the fluidic actuators and a respective fluid chamber of the fluid chambers.

5. The fluidic die of claim 1, wherein the dielectric layer provides a moisture barrier to reduce or prevent fluid ingress to the electrical structures.

6. The fluidic die of claim 1, wherein the dielectric layer comprises nitride containing material.

7. The fluidic die of claim 1, wherein the adhesion layer comprises a carbon containing material.

8. The fluidic die of claim 1, wherein the adhesion layer comprises an organic bonding layer.

9. The fluidic die of claim 1, wherein the adhesion layer comprises silicon carbide.

10. The fluidic die of claim 1, wherein the electrical structures comprise a power electrical structure and a ground electrical structure.

11. A method of forming a fluidic die, comprising:

forming fluidic actuators over a substrate;

forming electrical structures over the substrate;

forming a cavitation barrier layer over the fluidic actuators;

forming an adherent barrier layer over the cavitation barrier layer and the electrical structures, wherein forming the adherent barrier layer comprises:

forming a dielectric layer over the cavitation barrier layer and the electrical structures, patterning the dielectric layer away from a fluidic region, and coating an adhesion layer over the patterned dielectric layer, wherein a first portion of the adherent barrier layer covering the electrical structures includes the dielectric layer and the adhesion layer, and a second portion of the adherent barrier layer in the fluidic region includes the adhesion layer without the dielectric layer; and forming a fluidic barrier layer defining fluid chambers that are part of the fluidic region, the adherent barrier layer adhering the cavitation barrier layer to the fluidic barrier layer, and the adhesion layer of the second adherent barrier layer portion protruding into the fluid chambers.

12. The method of claim 11, wherein coating the adhesion layer over the dielectric layer fluidically isolates the dielectric layer from the fluid chambers.

13. The method of claim 11, wherein forming the fluidic barrier layer comprises applying a photolithography patterning of the fluidic barrier layer to form the fluid chambers, wherein the adhesion layer of the second adherent barrier layer portion is an interference anti-reflective layer that reduces optical reflection during the photolithography patterning of the fluidic barrier layer.

14. A fluidic die comprising:

a substrate;

a fluidic region comprising fluid chambers formed in a fluidic barrier layer supported by the substrate;

fluidic actuators associated with the fluid chambers;

electrical structures positioned away from the fluidic region;

a cavitation barrier layer over the fluidic actuators; and a die surface optimization (DSO) layer to adhere the cavitation barrier layer to the fluidic barrier layer, the DSO layer comprising a first DSO layer portion comprising a silicon nitride layer and a silicon carbide layer, and a second DSO layer portion comprising the silicon carbide layer and without the silicon nitride layer, the first DSO layer portion formed over the electrical structures, and the second DSO layer portion formed in the fluidic region, the silicon carbide layer of the second DSO layer portion protruding into the fluid chambers.

15. The fluidic die of claim 14, wherein the silicon carbide layer of the second DSO layer portion protrudes partially into the fluid chambers and comprises openings between the fluidic actuators and the respective fluid chambers, and the silicon carbide layer fluidically isolates the silicon nitride layer from the fluid chambers.

* * * * *